United States Patent [19]

Meisel et al.

[11] Patent Number: 5,031,964

[45] Date of Patent: Jul. 16, 1991

[54] CUTTING CHAIN FOR MINING MACHINES

[75] Inventors: Paul W. Meisel, Worthington; Mickey J. Hall, Westerville; Richard B. Graham, Columbus, all of Ohio

[73] Assignee: Dresser Industries, Inc., Dallas, Tex.

[21] Appl. No.: 541,837

[22] Filed: Jun. 21, 1990

[51] Int. Cl.[5] ..... E21C 25/34

[52] U.S. Cl. ..... 299/82; 299/84; 474/156

[58] Field of Search ..... 299/82, 83, 84, 91, 299/63; 474/155, 156, 157, 163

[56] References Cited

U.S. PATENT DOCUMENTS

| | | | |
|---|---|---|---|
| 3,679,265 | 7/1972 | Krekeler | 299/84 |
| 3,787,091 | 1/1974 | Paolini et al. | 299/84 |
| 3,788,711 | 1/1974 | Krekeler | 305/58 R |
| 3,802,287 | 4/1974 | Graham | 74/243 DR |
| 3,968,995 | 7/1976 | Arentzen | 474/156 X |
| 4,181,038 | 1/1980 | Shockley | 299/82 X |
| 4,275,929 | 6/1981 | Krekeler | 299/91 |
| 4,717,206 | 1/1988 | Starwerf, Jr. | 299/82 |

FOREIGN PATENT DOCUMENTS

| | | | |
|---|---|---|---|
| 100460 | 7/1980 | Japan | 474/156 |
| 588981 | 6/1947 | United Kingdom | 474/156 |
| 868605 | 5/1961 | United Kingdom | 299/82 |

*Primary Examiner*—Ramon S. Britts
*Assistant Examiner*—David J. Bagnell
*Attorney, Agent, or Firm*—Hubbard, Thurman, Tucker & Harris

[57] ABSTRACT

An endless chain for carrying cutting elements for a mining machine comprises a plurality of pivotally interconnected link elements, some of which are constructed to mount outwardly projecting cutting tools. The link elements are pivotally interconnected so as to provide sprocket openings along the two outer edges of the cutting chain. A pair of axially spaced sprockets secured to a driving drum engage the sprocket openings provided along the two longitudinal edges of the cutting chain. The sprocket teeth are dimensioned to be of less peripheral width than the sprocket openings and the pitch of the sprocket openings slightly exceeds the pitch of the sprocket teeth, thus insuring that the driving force imparted to the cutting chain by the sprockets is imparted only by the two leading sprocket teeth as they approach their point of exit from the chain openings.

12 Claims, 4 Drawing Sheets

CUTTING CHAIN FOR MINING MACHINES

BACKGROUND OF THE INVENTION

1. Field of the Invention

The invention relates to a method and apparatus for performing trimming or center cutting operations by a mining machine or the like.

2. Summary of the Prior Art

While the cutting chain of the present invention may have many applications, for purposes of an exemplary showing the chain will be described in its use as a trim chain for a non-oscillating, drum type mining machine.

Non-oscillating drum type mining machines have been in extensive use. Briefly, such machines generally comprise a self-propelled vehicle having a centrally located conveyor means for the material being mined. At the forward end of the machine, one or more movable beams support a horizontally oriented drum. The drum mounts a plurality of cutting tools on its periphery. Frequently, the cutting tools are oriented on the drum in a pattern comprising two oppositely oriented helices which are directed towards the center of the drum. This aids in conducting the cut material toward the center of the machine and the aforementioned conveyor.

Through appropriate drive mechanism and gearing, in association with the beam or beams, the drum is caused to rotate about its axis to produce a cutting action. At the position or positions where the drum is supported on one or more of the beams, the drum surface must be interrupted and cannot carry cutting tools. Therefore, one or more trim chains are required to fill in or overlap the one or more portions of the drum not provided with cutting tools.

Such trim chains are of closed loop configuration and, by virtue of the massive construction of such mining machines, it will be understood that the trim chains will have to be a considerable width. As a consequence, such trim chains usually carry a plurality of cutting tools oriented in staggered rows extending the width of the chain. See for example, U.S. Pat. No. 3,679,265.

In usual practice, the mining machine is moved into the face of the material being cut with the cutting drum positioned at the top of the face. Thereafter, through the agency of the beam or beams, the rotating cutting drum is caused to move downwardly, making a complete vertical cut at the face of the material. This procedure is then repeated and the mine entry is thereby advanced.

Heretofore, the aforementioned trim chains comprised a plurality of chain links which were pivotally interconnected together. Selected ones of said links were designed to accommodate cutting tools which were in the general shape of a rod with a pointed hardened end and were positioned on the links in a forwardly and angularly outwardly projecting direction relative to the external surface of the cutting chain so as to effect a cutting action on the face being mined. The maintenance of a specific angular position of the cutting tools relative to the face being mined is quite important.

The chain links were pivotally connected in such manner as to provide at least two axially spaced circles of openings to receive sprocket teeth. At least two axially spaced rows of sprocket teeth were secured to the central portions of the cutting drum and these teeth cooperated with the openings between the links of the cutting chain to impart a driving force to the cutting chain.

Heretofore, it was believed that the length dimension of the teeth of the sprocket and the pitch of the sprocket teeth should closely conform to the length of the chain openings and the pitch of the chain openings so that all of the sprocket teeth engaged in the openings would be imparting a driving force to the chain. It was believed that this would minimize the wear on the sprocket teeth and the chain and hence resulted in this configuration being essentially an industry standard.

With such standard configuration of the sprocket teeth and the chain link openings, it often happened that, due to wear, the driving force was imparted to the cutting chain more by the sprocket teeth entering the chain links than by the sprocket teeth approaching their exit point from the chain links. Due to the resistance to forward movement of the cutting chain resulting from the reaction forces on the cutting tools, the links carrying the cutting tools would be literally pushed away from the base of the sprocket and assume an angle different from that believed to be the optimum cutting angle. Moreover, since the chain links had internal surfaces conformed to snugly engage cylindrical surfaces on the sprockets intermediate the sprocket teeth, this would normally add a frictional driving force from the sprockets to the cutting chain. However, the bunching up or compression of the links of the cutting chain would move the internal link surfaces out of snug engagement with the cylindrical sprocket surfaces faces and hence impose a substantially greater force on the sprocket teeth that were doing the driving of the cutting chain. For this reason, the operation and useful life of cutting chains as heretofore designed and constructed has not been completely satisfactory.

SUMMARY OF THE INVENTION

The invention relates to a unique construction of a cutting chain for mining machines and the like and the driving sprockets for such chain, and the method of driving the cutting chain by such sprockets. The cutting chain carries a plurality of laterally adjacent rows of pivotally interconnected link elements. The link elements each comprise a primary link having transverse bores at its opposite ends. The primary links are interconnected by a pair of secondary links which are disposed on opposite sides of the ends of the adjacent primary links and traversed by bores at each end. Insertion of pivot pins through the aligned bores effects the pivotal connection of the links and concurrently effects the lateral connection of the laterally adjacent rows of link elements.

The lateral width of the medial portions of the primary links is enlarged to overlap slightly less than one half the width of the adjacent secondary links. Thus, when the primary and secondary links are pivotally interconnected, a plurality of openings are defined along both longitudinal edges of the resulting chain loop, bounded by the leading and trailing ends of the secondary links and the medial portions of the primary links. These edges openings are utilized to receive sprocket teeth which are mounted on the central portions of a power driven cutting drum. Such drum is driven in conventional fashion.

The pivotally interconnected chain links are utilized to support cutting tools. Such cutting tools are not necessarily provided on every link but are mounted on only some of the links so as to provide a staggered configuration of cutting tools across the length and width of the cutting chain. Each link to which a cutting tool is to be mounted is provided with an integral protuberance or hub which defines an outwardly open bore disposed at the proper angle relative to the direction of travel of the cutting tool to support the shank portion of a cutting tool in proper angular relationship for efficient cutting of the face being mined.

In accordance with this invention, the looped cutting chain is driven solely by a pair of axially spaced sprockets mounted on the central portions of the main cutting drum. The teeth of such sprockets are dimensioned to be significantly less in peripheral length than the edge openings of the cutting chain so as to be freely insertable in such openings. Additionally, the pitch of the openings of the cutting chain is significantly larger than the pitch of the sprocket teeth. With such an arrangement, all of the sprocket teeth are readily insertable in the link openings as the chain encircles the sprockets, but only the sprocket teeth approaching their respective exit points relative to the chain openings are in engagement with the surface of the chain to impart a driving force thereto.

This construction insures that only a tensile force is applied to the cutting chain by the sprockets and that such force is applied at a point beyond where the cutting tools are actively engaged with the surface being mined. With such an arrangement, the reaction forces on the cutting tools are transmitted to the links which support such cutting tools to force these links and the links pivotally connected thereto into snug frictional engagement with the cylindrical surfaces provided on the sprockets intermediate the sprocket teeth. Thus, the total force imparted by the driving drum to the cutting chain involves not only the force imparted by the leading sprocket teeth as they approach their exit points from the cutting chain, but also a frictional force exerted by the cylindrical surfaces of the sprockets operating against the conforming surfaces of the encircling chain links. Thus, force transmission to the cutting chain is always adequate and the cutting elements are never bunched together by a compressive force acting on the chain links, thus eliminating an undesirable angular displacement of the cutting tools from their optimum position relative to the face being mined.

The cutting chain embodying this invention is further improved through the unique formation of the links carrying the cutting tools. Each hub portion is traversed by a slot adjacent the bottom end of the bore within which the shank of the cutting tool is mounted in order to effect the securement of the cutting tool in such bore by the application of a C-ring to a groove provided on the inserted end of the cutting tool shank. The slot provided for this purpose is formed with a concave bottom surface which is tangentially related to the bore which accommodates the shank cutting tool. In this manner, a maximum of metal thickness is achieved for the body of the tool carrying length, thus helping to prevent inadvertent fracture of such links due to the forces encountered in the normal mining operation.

Additionally, each of the transverse bores provided in the primary and secondary links are offset by an amount sufficient to compensate for wear on the inner surface of the links. The offset of the axes of such bores is therefore in a direction toward the outer face of the links and thus provides a greater wear thickness for the inner surfaces of the links.

A still further feature of this invention lies in the fact that the provision of a medial thickened portion on each primary link results in the cutting chain being substantially free of significant openings across the width thereof, except, of course, for the sprocket openings deliberately provided along each longitudinal edge of the cutting chain. This again contributes to the overall strength and wearability of the cutting chain.

Finally, the tip portions of the sprocket teeth are rounded so that each tooth exits from the chain substantially concurrently with the engagement of the next tooth with the forward wall surface of the next sprocket opening of the cutting chain. This provides a smooth application of driving force to the cutting chain.

Further advantages of the invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 1A:
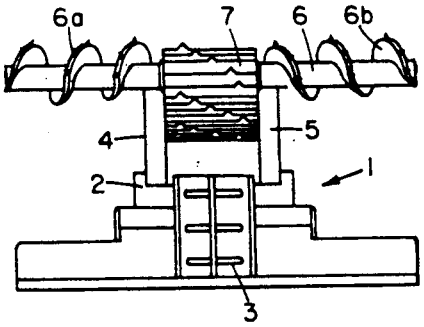
FIG. 1A (PRIOR ART)
FIG. 1A is a schematic elevational view of a prior art mining machine to which this invention may be applied.
Figure 1B:
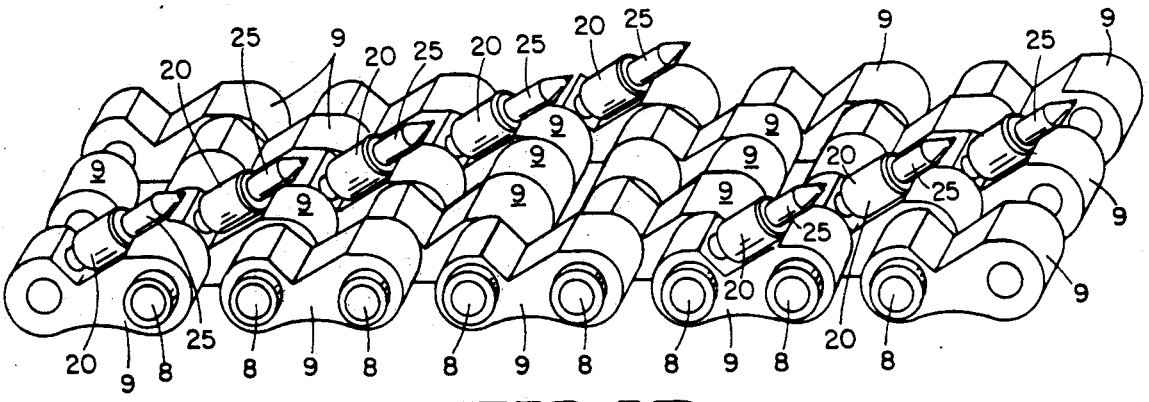
FIG. 1B (PRIOR ART)
FIG. 1B is a perspective view of a prior art cutting chain for a mining machine.
Figure 1C:
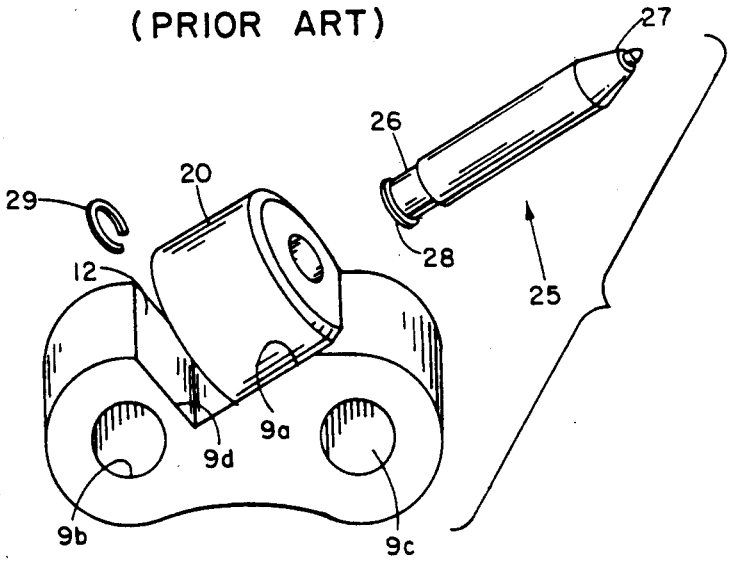
FIG. 1C (PRIOR ART)
FIG. 1C is an exploded view of a prior art tool mounting link for a prior art cutting chain.

Referring first to FIGS. 1A, 1B and 1C, there is schematically illustrated a prior art mining machine employing a prior art cutting chain formed of prior art link elements. The prior art mining machine 1 has a self-propelled body portion 2 with a centrally located conveyor means 3. A pair of spaced, movable beams 4 and 5 support a rotatable drum 6 having two helical rows of cutting tools **6*a* and 6*b***. Appropriate drive means (not shown) for the drum is located in association with or between the beams.

The machine is provided with a looped trim chain 7 to cut clearance for that portion of the drum which cannot otherwise be equipped with bits, i.e., that portion of the drum which must be supported by the beams 4 and 5 and that portion operatively connected to the drive mechanism for the drum. The trim chain 7 may be driven by any suitable means such as sprocket wheels, which are not shown in FIG. 1A.

FIG. 1B illustrates a typical prior art looped cutting chain formed of connecting links 9 which are pivotally interconnected by transverse connecting pins 8. Selected links of the cutting chain are employed to mount tool supporting hubs 20 which have bores 20*a* to mount cutting tools 25.

As best shown in FIG. 1C, the prior art cutting tools comprise an elongated shank 26 snugly insertable in bore 20*a* terminating at one end in a tapered, hardened cutting tip 27 and terminating at the other end in an abutment surface 28 adapted to cooperate with the wall surface 9*d* of a notch 12 provided on the respective tool supporting element 20. The tool supporting element 20 is, in the prior art constructions, welded to, or folded onto, a planar surface 9*a* provided on the link element 9 and defines the notch 12 through which a retaining C-ring 29 may be mounted on a reduced diameter groove portion 26*a* of the cutting tool 25 to secure the tool shank 26 to the tool supporting element 20.

It should be particularly noted that the prior art constructions have the axes of the transverse bores 9*b* and 9*c* of each link 9 located centrally with respect to the width of the link 9. Moreover, the minimum thickness portion of the link 9 is defined by the intersection of the planar surface 9*a* and the abutment surface 9*d*.

Figure 2:
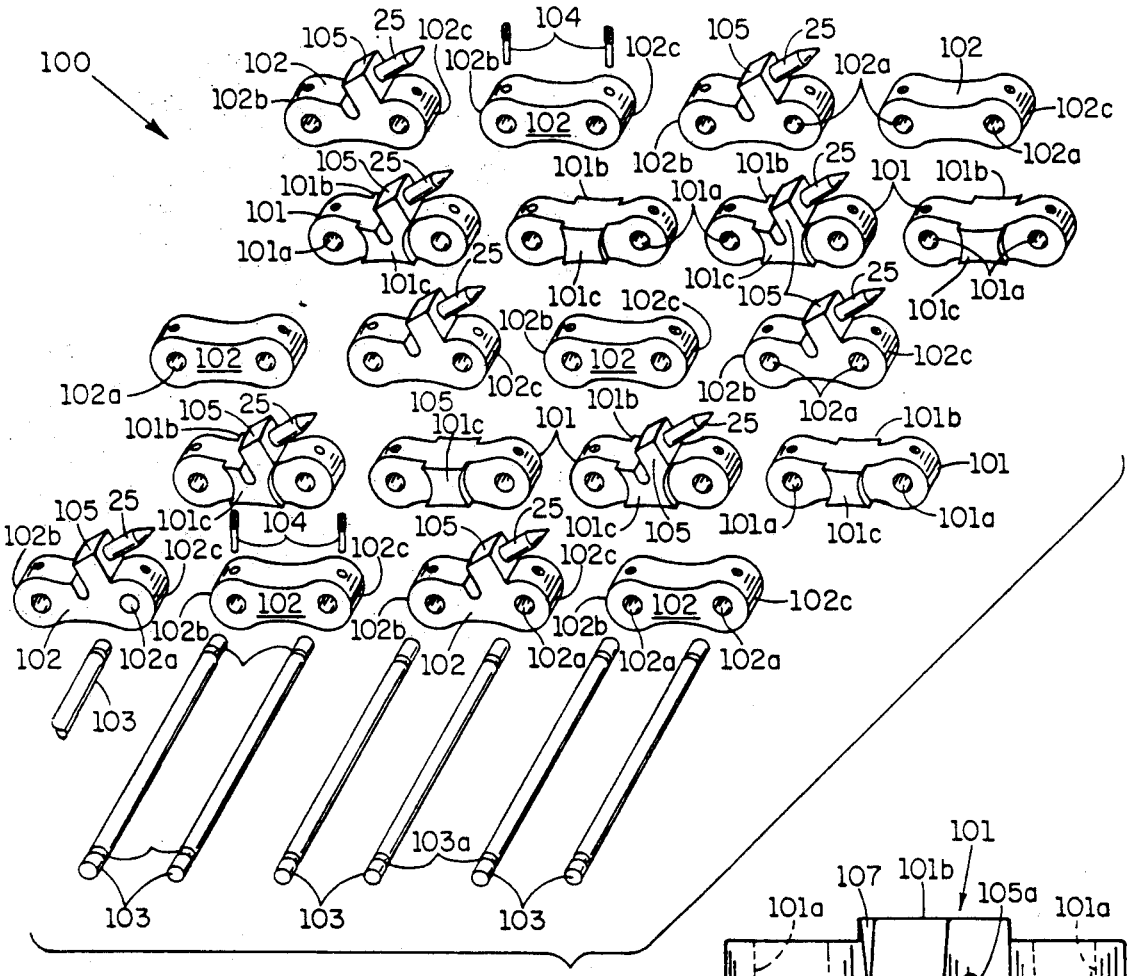
FIG. 2 is an exploded perspective view of a portion of a cutting chain embodying this invention, with the chain shown in a non-loop configuration for simplicity of illustration.

Referring now to FIG. 2, there is shown a cutting chain 100 embodying this invention comprising a plurality of interconnected primary links 101 and secondary links 102. Each primary link 101 is provided with transverse bores 101*a* at each end thereof and the secondary links 102 are similarly provided with transverse bores 102*a* at each end thereof. These bores are aligned, with each primary link having two secondary links respectively disposed on opposite sides of each end thereof and the aligned bores 101*a* and 102*a* are traversed by a pivot pin 103. Pivot pin 103 is provided with a pair of annular grooves 103*a* and these grooves respectively receive dowel pins 104 to secure the outside links in a fixed lateral position relative to the transverse pivot pin 103.

Figure 3:
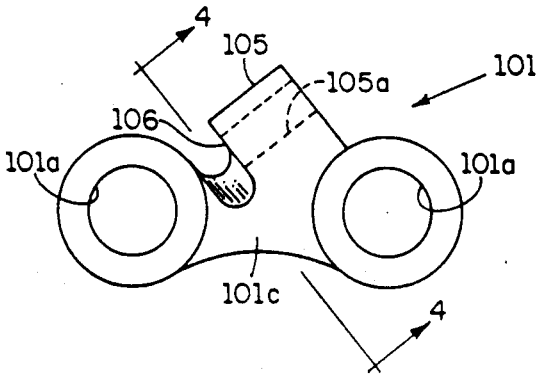
FIG. 3 is a side elevational view of a primary link element for the cutting chain.
Figure 4:
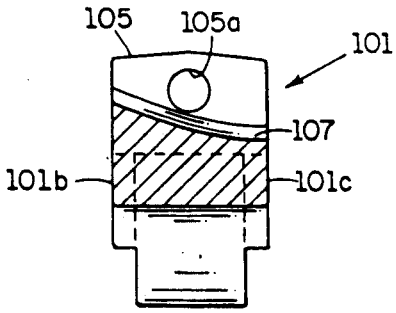
FIG. 4 is a sectional view taken on the plane 4—4 of FIG. 3.
Figure 6:
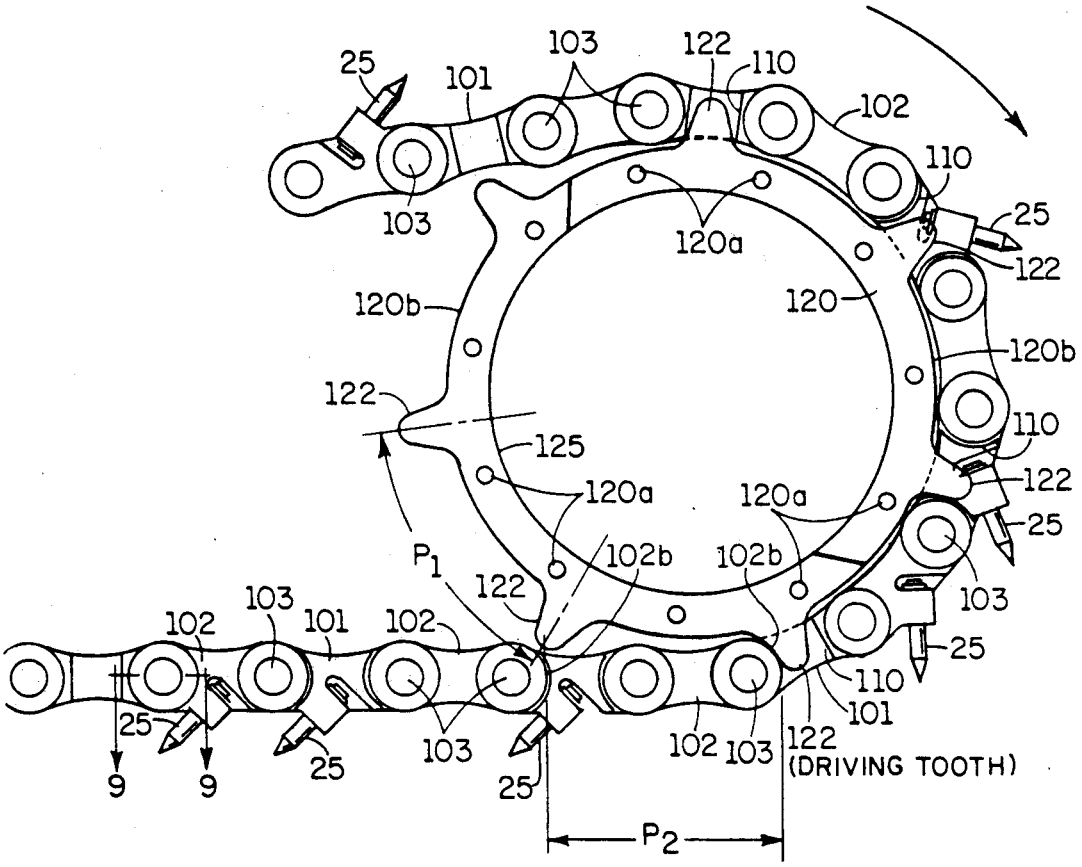
FIG. 6 is a side elevational view of the cutting chain and driving sprocket embodying this invention.
Figure 9:
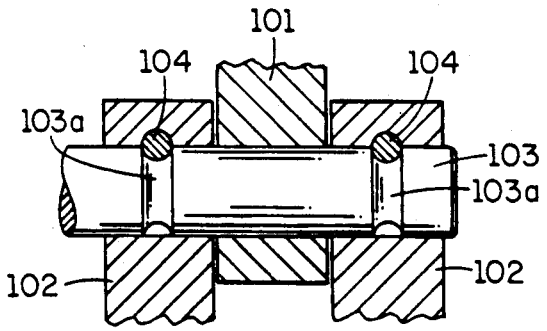
FIG. 9 an enlarged scale sectional view taken on the plane 9—9 of FIG. 6.

The interrelationship between primary links 101 and secondary links 102 is more clearly shown in the schematic view of FIG. 6 wherein such links are shown in assembled relationship. A selected number of the links are provided with tool mounting hub portions 105 and these hub portions are best illustrated in FIGS. 3 and 4. Hub portions 105 are traversed by a bore 105*a* and are sized so as to snugly receive the shank portion 26 of a conventional cutting tool 25 shown in FIG. 1C.

The tool mounting hubs 105 are provided on selected links 101 and 102 to provide successive V-shaped arrays of cutting tools 25 along the length of cutting chain 100, as best shown in the schematic view of FIG. 6. As shown in FIGS. 3 and 4, regardless of whether the cutting tool 25 is to be mounted on a primary link 101 or secondary link 102, a notch 106 is milled through the inner portions of tool mounting hubs 105 to permit a C-ring retainer 29 to be applied to the tool shank 26 in the same manner as prior art construction of FIG. 1C. However, the bottom of milled slot 106 is provided with a concave surface 107 which is tangential to the bore 105*a*. (FIG. 4). This configuration provides additional metal, hence increased strength for the links 101 or 102 carrying cutting tools 25.

Figure 7:
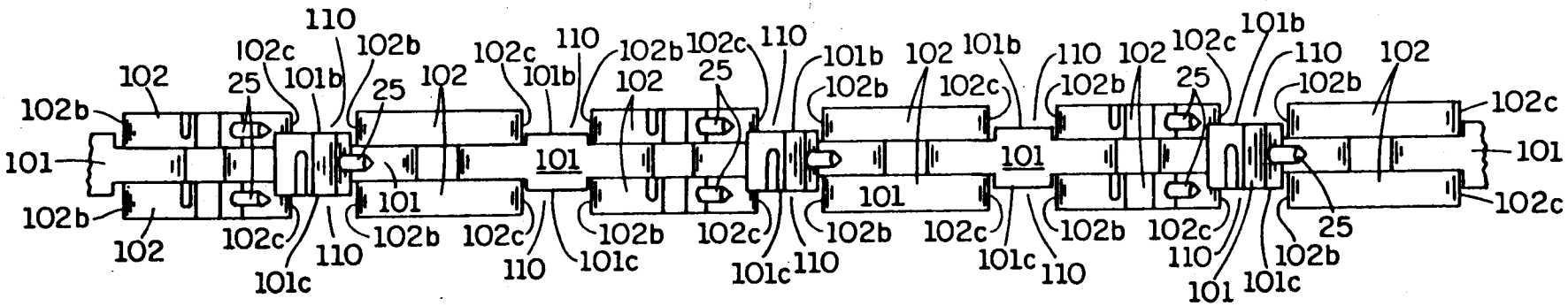
FIG. 7 is a top plan view of a longitudinal portion of a minimum width cutting chain embodying this invention.
Figure 8:
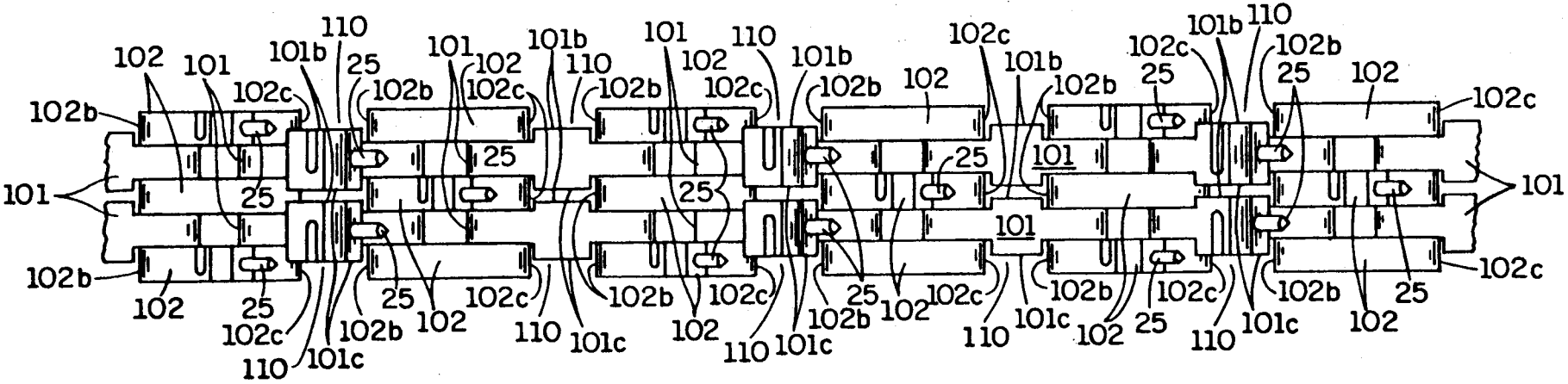
FIG. 8 is a top plan view of a longitudinal portion of a cutting chain embodying the components shown in FIG. 2 in an assembled state.

If a minimum width cutting chain is desired, this may be accomplished by utilizing only a single row of primary links 101 which are interconnected at both ends by spaced secondary links 102 in the manner schematically illustrated in FIG. 7.

Referring to FIGS. 3, 4 and 6, it will be observed that each of the primary links 101 is provided with a thickened medial portion defining lateral projections 101*b* and 101*c*. These lateral projections are preferably slightly less than one half the thickness of the secondary links 102 so that when assembled, as indicated in the schematic view of FIG. 6, the lateral projections 101*b* and 101*c* substantially fill in the space existing between the secondary links 102 intermediate the ends of primary links 101. With this configuration, the lateral projections 101*b* or 101*c* as the case may be, of the outermost row of primary links 101 cooperate with the adjacent end surfaces 102*b* and 102*c* of the adjacent secondary links 102 to define sprocket openings 110. This is also true for the minimum width configuration shown in FIG. 7.

Referring now to FIG. 6, it will be observed that sprocket segments 120 are provided on the central portions of a cutting drum 125 by appropriate bolts 120*a*. These sprocket segments 120 have teeth 122 which have a peripheral width significantly less than the peripheral width of the sprocket openings 110. The peripheral spacing of the sprocket teeth 122 represented by the pitch dimension P1 is, however, less than the pitch dimension P2 of the sprocket openings 110. Thus the sprocket teeth 122 are readily insertable in the sprocket openings 110 of the cutting chain 100 but only the tooth marked "driving tooth" in FIG. 6, which is approaching its exit position from the chain, actually exerts any driving force on the cutting chain 100. Moreover, the tip portions of the sprocket teeth 122 are accurately configured so that when the one tooth exits from the sprocket opening 110 of the cutting chain 100 the next tooth will substantially concurrently engage the forward wall surface of the next sprocket opening 110. Such forward wall surface is, of course, the rearwardly facing surface 102*b* of a secondary link 102. (FIGS. 6 or 7) As best shown in FIG. 6, the internal surfaces of both the links 101 and 102 are concavely formed so that a substantial portion of such links snugly abut a cylindrical segment surface 120*b* provided on the sprocket segments 120.

With the aforedescribed method of driving the cutting chain 100 by only the sprocket tooth approaching its exit point relative to the cutting chain, it is insured that a tensile force will be applied at all times to the portion of the cutting chain 100 encircling the sprocket segments 120, causing it to snugly hug the support surfaces 120*b* and thereby frictionally impart additional driving force to the cutting chain 100. More importantly, the cutting tools 25 carried by the cutting chain 100 are thereby assured of being in a proper cutting position with respect to the face of the formation being mined.

Figure 5:
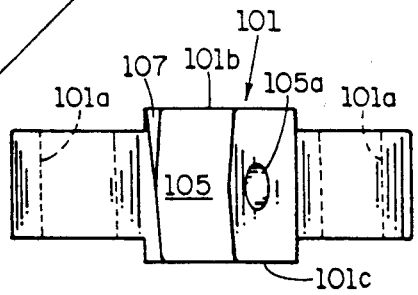
FIG. 5 is a top plan view of FIG. 3.

Another feature of this invention, best shown in FIG. 5, is the location of the transverse bores 101*a* and 102*a* of the primary links 101 and the secondary links 102 respectively, so as to be outwardly offset relative to the internal surface of the cutting chain. Such outward offset provides additional metal on the inner face of the chain which can be worn off without in any manner affecting the efficient operation of the cutting chain.

From the foregoing description, it will be apparent that the method and apparatus of this invention provides a cutting chain for a mining machine or the like which will efficiently cut a face to be mined with the cutting tools being always properly angularly disposed relative to such face. Moreover, the cutting chain embodying this invention is not adversely affected by the normal wear of the internal surfaces of the chain. Hence, extended life of cutting chains may be anticipated through the utilization of this invention.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A clearance cutter for a mining machine comprising:

a continuous loop chain having a plurality of cutting bits projecting from its external surface, said continuous loop chain having a plurality of pivotally interconnected link elements, some of said link elements carrying said cutting bits;

means for pivotally interconnecting said link elements to define longitudinally spaced openings between successive link elements;

a power driven sprocket cooperating with the inner face of said continuous loop chain for a selected angular distance;

said sprocket having a plurality of peripherally spaced, radially projecting teeth successively insertable in said openings between said link elements, and successively exiting from said chain openings as said sprocket rotates through said selected angular distance;

the peripheral width of said teeth being less than the peripheral length of said openings;

the pitch of said sprocket teeth being less than pitch of said openings, whereby driving force is successively transferred to said chain only by each sprocket tooth approaching its exit point relative to said chain; and wherein each of said link elements comprises:

a primary link body having a transverse bore at each longitudinal end and a laterally enlarged medial portion;

said means for pivotally interconnecting said primary link elements comprising a pair of secondary link bodies, each having a transverse bore at each longitudinal end pivot means traversing said transverse bores to pivotally secure each primary link body at both ends between two laterally spaced secondary link bodies;

the lateral widths of the medial portions of said primary link bodies longitudinally intermediate said secondary link bodies being less than the assembled lateral widths of said secondary link bodies, thereby defining said openings between said link elements.

2. The apparatus of claim 1 wherein the trailing end of each secondary link body defines the forward wall of each said opening engaged by a sprocket tooth approaching its exit point relative to the belt.

3. The apparatus of claim 1 wherein the axis of each of said transverse bores in said primary and secondary link bodies is offset to lie closer to the outer face of said continuous loop chain than the inner face, thereby providing greater wear thickness for the inner surfaces of said primary and secondary link bodies.

4. The apparatus of claim 1 wherein the increased lateral width of the medial portion of said primary link body adjacent said respective opening is substantially greater than the width of the longitudinal end portions of said primary link body, but less than one half the width of said secondary link body.

5. The apparatus of claim 1 wherein some link elements mounting tool bits comprise:

link bodies, each having transverse bores in both ends thereof;

an integral outwardly projecting hub portion formed on the medial portion of each said some link elements;

an outwardly open bore in said hub portion having an axis disposed in angular relation to the length of said link body;

said outwardly open bore being sized to snugly receive the shank portion of a tool bit;

a slot formed in said integral hub portion intersecting said outwardly open bore adjacent the inner end of said bore to permit a retaining element to be applied to an inserted shank portion of a tool bit;

said slot having a concave bottom wall tangentially intersecting said bore, thereby maximizing the thickness of said medial portion of each said some link elements.

6. A clearance cutter for a mining machine comprising:

a power driven rotating cutting drum;

two axially spaced sprockets secured to axially spaced central portions of said cutting drum, said sprockets having peripherally spaced teeth;

a continuous loop chain having an inner surface conforming to and engageable with portions of said sprockets intermediate said sprocket teeth;

said continuous loop chain having a plurality of cutting tools projecting from its external surface;

said continuous loop chain having a plurality of interconnected link elements arranged in longitudinally extending laterally adjacent rows, some of said link elements respectively carrying said cutting tools;

means for pivotally interconnecting said link elements to define longitudinally spaced openings between successive link elements along both longitudinal edges of said loop chain, each of said openings having a forward force transmitting surface; and each of said link elements comprising:

a primary link body having a transverse bore at each longitudinal end and a laterally enlarged medial portion;

said cutting tools being mounted in said laterally enlarged medial portions;

said means for pivotally interconnecting said primary link elements comprising a pair of secondary link bodies each having a transverse bore at each longitudinal end;

pivot means traversing said transverse bores to pivotally secure each primary link body at both ends between two laterally spaced secondary link bodies;

the increased lateral width of said medial portions of said primary link bodies intermediate said secondary link bodies being less than one half of the lateral width of said secondary link bodies, thereby defining said openings along both longitudinal edges of said chain loop;

the peripheral width of each of said sprocket teeth being less than the peripheral length of said openings, whereby each sprocket tooth is insertable in a respective opening, and the pitch of said sprocket teeth being less than pitch of said loop chain openings, whereby driving force is successively transferred to each force transmitting surface of said loop chain only by each sprocket tooth approaching its exit point relative to said chain.

7. The apparatus of claim 6 wherein the trailing end of each laterally outermost secondary link body defines said forward force transmitting surface of each of said opening.

8. The apparatus of claim 6 wherein the axis of each of said transverse bores in said primary and secondary link bodies is offset to lie closer to the outer face of said continuous loop chain than the inner face, thereby providing greater wear thickness for the inner surfaces of said primary and secondary link bodies.

9. The apparatus of claim 6 wherein the lateral width of the medial portion of said primary link body adjacent said opening is substantially greater than the width of the longitudinal end portions of said primary link body.

10. The apparatus of claim 6 wherein said some link elements mounting tool bits comprise:

link bodies, each having transverse bores in both ends thereof for receiving interconnecting pivot pins;

an integral, outwardly projecting hub portion formed on the medial portion of each said some link elements;

an outwardly open bore in said hub portion having axis disposed in angular relation to the length of said link body;

said outwardly open bore being sized receive the shank portion of a tool bit;

a slot formed in said integral hub portion intersecting said outwardly open bore adjacent the inner end of said bore to permit a retaining element to be applied to an inserted shank portion of a tool bit;

said slot having a concave bottom wall tangentially intersecting said bore, thereby maximizing the thickness of said medial portion of each said some link elements.

11. A clearance cutter for a mining machine comprising:

a continuous loop chain assembly, said loop chain assembly having a plurality of pivotally interconnected link elements;

each said link element comprising:

a primary link body having a transverse bore at each longitudinal end and a laterally enlarged medial portion, a pair of secondary link bodies, each having a transverse bore at each longitudinal end, pivot means traversing said transverse bores to pivotally secure each primary link body at both ends between two laterally spaced secondary link bodies, the lateral width of said medial portion of said primary link bodies longitudinally intermediate said secondary link bodies being less than the assembled lateral width of said secondary link bodies, thereby defining openings between said link elements;

a cutting element mounted in said laterally enlarged portion of selected ones of said link elements;

a power driven sprocket cooperating with the inner face of said continuous loop chain for a selected angular distance;

said sprocket having a plurality of peripherally spaced, radially projecting teeth successively insertable in said openings between said link elements, and successively exiting from said chain openings as said sprocket rotates through said selected angular distance.

12. The apparatus of claim 11 wherein said plurality of pivotally interconnected link elements are arranged in longitudinally extending, laterally adjacent rows with said openings being disposed along the two lateral edges of said continuous loop chain.

* * * * *